US006433266B1

(12) United States Patent
Fay et al.

(10) Patent No.: US 6,433,266 B1
(45) Date of Patent: Aug. 13, 2002

(54) PLAYING MULTIPLE CONCURRENT INSTANCES OF MUSICAL SEGMENTS

(75) Inventors: Todor C. Fay, Bellevue; Mark T. Burton, Redmond, both of WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 09/243,192

(22) Filed: Feb. 2, 1999

(51) Int. Cl.[7] ..... A63H 5/00; G04B 13/00; G10H 7/00

(52) U.S. Cl. ..... 84/609; 84/634

(58) Field of Search ..... 84/601, 609, 613, 84/634, 637, 645

(56) References Cited

U.S. PATENT DOCUMENTS 4,526,078 A * 7/1985 Chadabe ..... 84/1.03
4,716,804 A * 1/1988 Chadabe ..... 84/1.03
5,052,267 A * 10/1991 Ino ..... 84/613
5,164,531 A * 11/1992 Imaizumi et al. ..... 84/634
5,179,241 A * 1/1993 Okuda et al. ..... 84/613
5,218,153 A * 6/1993 Minamitaka ..... 84/613
5,278,348 A * 1/1994 Etaki et al. ..... 84/636
5,281,754 A * 1/1994 Farrett et al. ..... 84/609
5,286,908 A * 2/1994 Jungleib ..... 81/603
5,315,057 A * 5/1994 Land et al. ..... 84/601
5,355,762 A * 10/1994 Tabata ..... 84/609
5,455,378 A * 10/1995 Paulson et al. ..... 84/610
5,496,962 A * 3/1996 Meier et al. ..... 84/601
5,596,159 A * 1/1997 O'Connell ..... 84/645 X
5,734,119 A * 3/1998 France et al. ..... 84/645 X
5,753,843 A * 5/1998 Fay ..... 84/609
5,902,947 A * 5/1999 Burton et al. ..... 84/609 X

* cited by examiner

*Primary Examiner*—Jeffrey Donels
(74) *Attorney, Agent, or Firm*—Lee & Hayes PLLC

(57) ABSTRACT

A musical performance is generated by a segment object and a plurality of constituent track objects. Multiple segment instances can be played concurrently by instantiating multiple state objects corresponding to the segment instances. Each state object stores state information for the track objects of the segment object. When calling a track object to play a portion of its track, the state object provides the stored state information and the track object plays in accordance with the provided state information. The track object updates the state information and returns it to the segment object. Each state object calls the same track objects, but maintains a different set of state information for use by the track objects. This allows multiple concurrent instances of the tracks, without requiring actual duplication of the track objects.

30 Claims, 6 Drawing Sheets

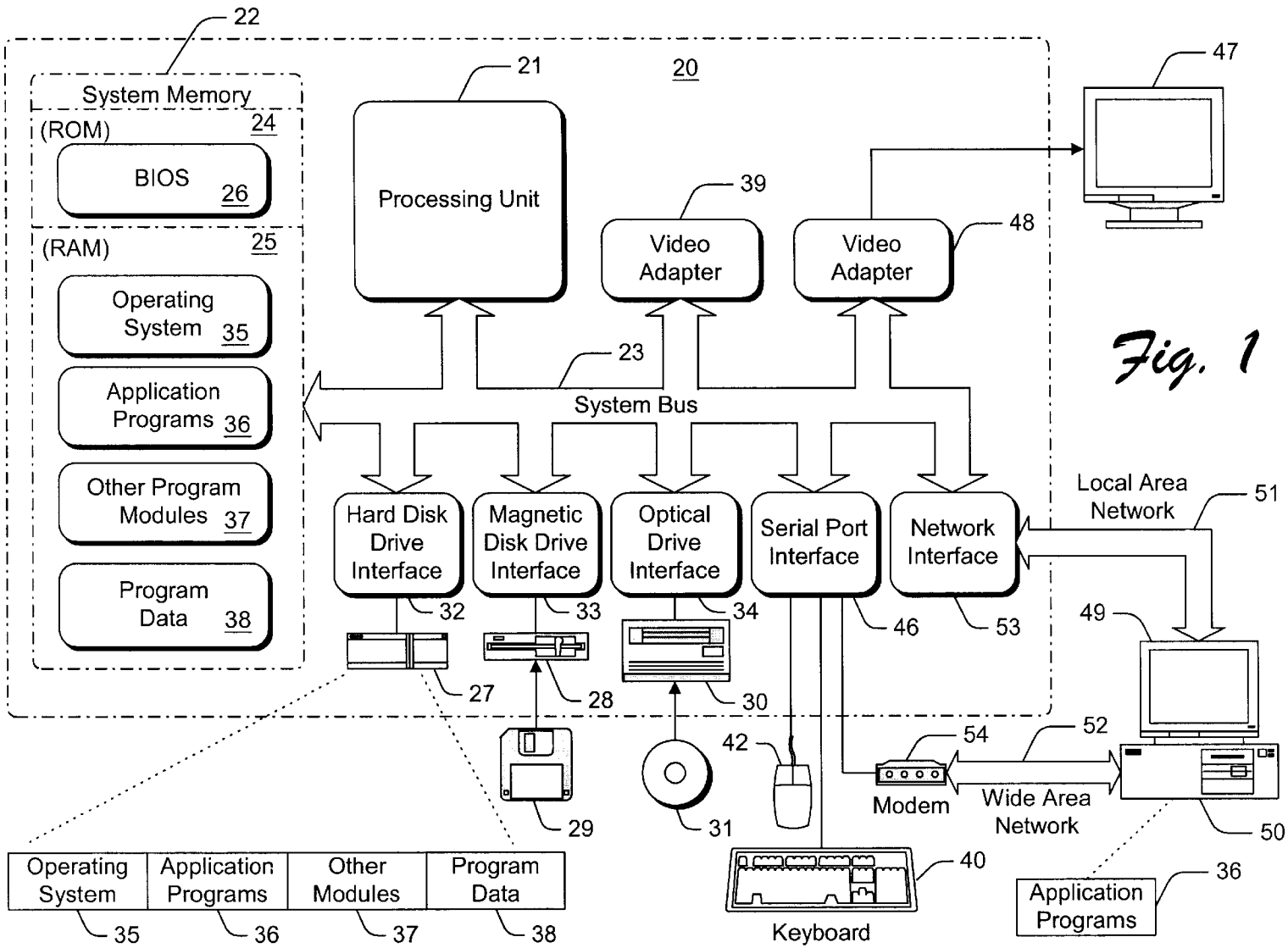
Fig. 1
20
21
Processing Unit
22
System Memory
(ROM)
24
BIOS
26
(RAM)
25
Operating System
35
Application Programs
36
Other Program Modules
37
Program Data
38
23
System Bus
Video Adapter
48
Video Adapter
39
47
Hard Disk Drive Interface
32
Magnetic Disk Drive Interface
33
Optical Drive Interface
34
Serial Port Interface
46
Network Interface
53
Local Area Network
51
49
52
Wide Area Network
54
Modem
50
Keyboard
40
42
30
31
28
29
27
Program Data
38
Other Modules
37
Application Programs
36
Operating System
35
Application Programs
36

PLAYING MULTIPLE CONCURRENT INSTANCES OF MUSICAL SEGMENTS

TECHNICAL FIELD

This invention relates to the computerized playback of musical segments and their constituent tracks. Specifically, the invention relates to playing multiple instances of given segment concurrently with each other.

BACKGROUND OF THE INVENTION

Musical performances have become a key component of electronic and multimedia products such as stand-alone video game devices, computer-based video games, computer-based slide show presentations, computer animation, and other similar products and applications. As a result, music generating devices and music playback devices are now tightly integrated into electronic and multimedia components.

Musical accompaniment for multimedia products can be provided in the form of digitized audio streams. While this format allows recording and accurate reproduction of non-synthesized sounds, it consumes a substantial amount of memory. As a result, the variety of music that can be provided using this approach is limited. Another disadvantage of this approach is that the stored music cannot be easily varied. For example, it is generally not possible to change a particular musical part, such as a bass part, without re-recording the entire musical stream.

Because of these disadvantages, it has become quite common to generate music based on a variety of data other than pre-recorded digital streams. For example, a particular musical piece might be represented as a sequence of discrete notes and other events corresponding generally to actions that might be performed by a keyboardist-such as pressing or releasing a key, pressing or releasing a sustain pedal, activating a pitch bend wheel, changing a volume level, changing a preset, etc. An event such as a note event is represented by some type of data structure that includes information about the note such as pitch, duration, volume, and timing. Music events such as these are typically stored in a sequence that roughly corresponds to the order in which the events occur. Rendering software retrieves each music event and examines it for relevant information such as timing information and information relating the particular device or "instrument" to which the music event applies. The rendering software then sends the music event to the appropriate device at the proper time, where it is rendered. The MIDI (Musical Instrument Digital Interface) standard is an example of a music generation standard or technique of this type, which represents a musical performance as a series of events.

There are a variety of different techniques for storing and generating musical performances, in addition to the event-based technique utilized by the MIDI standard. As one example, a musical performance can be represented by the combination of a chord progression and a "style". The chord progression defines a series of chords, and the style defines a note pattern in terms of chord elements. To generate music, the note pattern is played against the chords defined by the chord progression.

A "template" is another example of a way to represent a portion of a musical performance. A template works in conjunction with other composition techniques to create a unique performance based on a musical timeline.

These different techniques correspond to different ways of representing music. When designing a computer-based music generation and playback system, it is desirable for the system to support a number of different music representation technologies and formats, such as the MIDI, style and chord progression, and template technologies mentioned above. In addition, the playback and generation system should support the synchronized playback of traditional digitized audio files, streaming audio sources, and other combinations of music-related information such as lyrics in conjunction with sequenced notes.

U.S. patent application Ser. No. 5,753,843, issued to Microsoft on May 19, 1998, describes a system for generating music in accordance with the techniques described above. In addition, a concurrently-filed United States Patent Application, entitled "Track-Based Music Performance Architecture" by inventors Todor C. Fay and Mark T. Burton, describes a music generation architecture that easily accommodates various different types of music generation techniques. In the system described in that application, a piece of music is embodied as a programming object, referred to as a segment object, that represents a segment of music. The segment object has an interface that can be called by a playback program to play identified portions of the segment. Each segment comprises a plurality of tracks, embodied as track objects. The track objects are of various types for generating music in a variety of different ways, based on a variety of different data formats.

Each track, regardless of its type, supports an identical interface, referred to as a track interface, that is available to the segment object. When the segment object is instructed to play a music interval, it passes the instruction on to its constituent tracks, which perform the actual music generation. In many cases, the tracks cooperate with each other to produce music. The cited application describes inter-track object interfaces that facilitate communication between the tracks, thereby allowing one track to obtain data from another track. This is used, for example, by a style track in order to obtain chord information from a chord progression track—the style track needs the chord information for proper interpretation of notes within the style track, which are defined in terms of chord elements.

It has been found that it would be desirable to be able to initiate multiple instances of a given segment, for playback during overlapping times. Because a segment is implemented as a set of tracks, each segment instance would correspond to a set of track instances. At any given time, each track instance would be playing a different portion of the track's music.

In most cases, however, it is not feasible to use a single track object to represent or play multiple instances of a given musical track. This is because playing a track usually involves maintaining at least a minimal amount of changing state information. In a simple case, such state information might comprise the temporal point within the track at which playback is currently taking place. This changes with time, as playback of the track proceeds. In more complex situations, tracks might have a need for much more extensive state data. For example, a track might have different sequence and chord variations that are chosen when the track is initiated. With a track like this, each track instance might have chosen a different sequence and chord variation, and thus require state data to indicate the particular choice of sequence and chord for each instance. As another example, a track might have characteristics that change over time, depending on some sort of environmental or user input. In this case, the track would need to maintain information about previous inputs to determine its current characteristics.

It would be possible to solve this problem by simply instantiating duplicate copies of each set of track objects, so that each segment instance would corresponds to a different set of actual track objects. However, this would quickly increase memory requirements beyond reasonable levels. Accordingly, there is a need for a different method of playing multiple segment instances.

SUMMARY OF THE INVENTION

In accordance with the invention, a track manager manages playback of a segment and its tracks. In response to a request for a new instance of the segment, the track manager signals each of the segment's tracks to initialize itself with new state information. The tracks pass this state information back to the track manager.

During track playback, the track manager makes repeated calls to the individual tracks to play sequential portions of their music. Each track, rather than maintaining its own state information, receives its state information from the calling track manager. In this way, the track manager can maintain different state information corresponding to different track instances, which in turn correspond to different instances of music segments. By providing different state information at different times to the tracks, the track manager can play multiple segment instances without having to duplicate the individual tracks.

As another aspect of the invention, track manager is implemented as a single segment object in conjunction with multiple state objects corresponding to different segment instances. The state objects keep track of state data corresponding to different segment and track instances. The state objects are called by a performance manager or object to play the different segment and track instances at different times.

BRIEF DESCRIPTION OF THE DRAWINGS

FIG. 1 is a block diagram of a computer system that implements the invention.

DETAILED DESCRIPTION

Computing Environment

Figure 2:
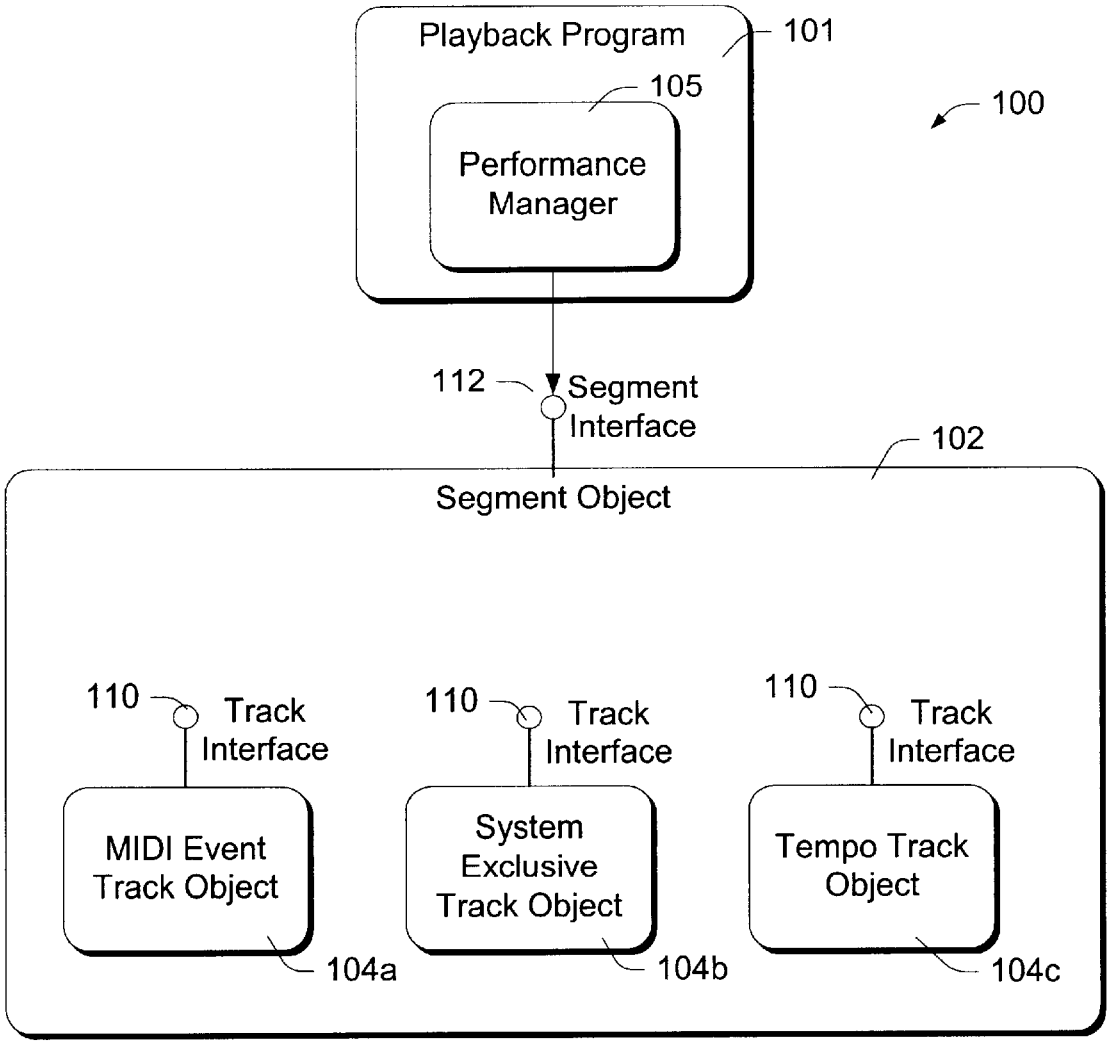
FIG. 2 is a block diagram showing software components for playing segment-based music in accordance with an embodiment of the invention.

FIG. 1 and the related discussion are intended to provide a brief, general description of a suitable computing environment in which the invention may be implemented. Although not required, the invention will be described in the general context of computer-executable instructions, such as programs and program modules that are executed by a personal computer. Generally, program modules include routines, programs, objects, components, data structures, etc. that perform particular tasks or implement particular abstract data types. Moreover, those skilled in the art will appreciate that the invention may be practiced with other computer system configurations, including hand-held devices, multiprocessor systems, microprocessor-based or programmable consumer electronics, network PCs, minicomputers, mainframe computers, and the like. The invention may also be practiced in distributed computer environments where tasks are performed by remote processing devices that are linked through a communications network. In a distributed computer environment, program modules may be located in both local and remote memory storage devices.

An exemplary system for implementing the invention includes a general purpose computing device in the form of a conventional personal computer 20, including a microprocessor or other processing unit 21, a system memory 22, and a system bus 23 that couples various system components including the system memory to the processing unit 21. The system bus 23 may be any of several types of bus structures including a memory bus or memory controller, a peripheral bus, and a local bus using any of a variety of bus architectures. The system memory includes read only memory (ROM) 24 and random access memory (RAM) 25. A basic input/output system 26 (BIOS), containing the basic routines that help to transfer information between elements within personal computer 20, such as during start-up, is stored in ROM 24. The personal computer 20 further includes a hard disk drive 27 for reading from and writing to a hard disk, not shown, a magnetic disk drive 28 for reading from or writing to a removable magnetic disk 29, and an optical disk drive 30 for reading from or writing to a removable optical disk 31 such as a CD ROM or other optical media. The hard disk drive 27, magnetic disk drive 28, and optical disk drive 30 are connected to the system bus 23 by a hard disk drive interface 32, a magnetic disk drive interface 33, and an optical drive interface 34, respectively. The drives and their associated computer-readable media provide nonvolatile storage of computer readable instructions, data structures, program modules and other data for the personal computer 20. Although the exemplary environment described herein employs a hard disk, a removable magnetic disk 29 and a removable optical disk 31, it should be appreciated by those skilled in the art that other types of computer readable media which can store data that is accessible by a computer, such as magnetic cassettes, flash memory cards, digital video disks, Bernoulli cartridges, random access memories (RAMs) read only memories (ROM), and the like, may also be used in the exemplary operating environment.

RAM 25 forms executable memory, which is defined herein as physical, directly-addressable memory that a microprocessor accesses at sequential addresses to retrieve and execute instructions. This memory can also be used for storing data as programs execute.

A number of programs and/or program modules may be stored on the hard disk, magnetic disk 29 optical disk 31, ROM 24, or RAM 25, including an operating system 35, one or more application programs 36, other program objects and modules 37, and program data 38. A user may enter commands and information into the personal computer 20 through input devices such as keyboard 40 and pointing device 42. Other input devices (not shown) may include a microphone, joystick, game pad, satellite dish, scanner, or the like. These and other input devices are often connected to the processing unit 21 through a serial port interface 46 that is coupled to the system bus, but may be connected by other interfaces, such as a parallel port, game port, or a universal serial bus (USB). A monitor 47 or other type of display device is also connected to the system bus 23 via an interface, such as a video adapter 48. In addition to the monitor, personal computers typically include other peripheral output devices (not shown) such as speakers and printers.

Computer 20 includes a musical instrument digital interface ("MIDI") component 39 that provides a means for the computer to generate music in response to MIDI-formatted data. In many computers, such a MIDI component is implemented in a "sound card," which is an electronic circuit installed as an expansion board in the computer. The MIDI component responds to MIDI events by playing appropriate tones through the speakers of the computer.

The personal computer 20 may operate in a networked environment using logical connections to one or more remote computers, such as a remote computer 49. The remote computer 49 may be another personal computer, a server, a router, a network PC, a peer device or other common network node, and typically includes many or all of the elements described above relative to the personal computer 20, although only a memory storage device 50 has been illustrated in FIG. 1. The logical connections depicted in FIG. 1 include a local area network (LAN) 51 and a wide area network (WAN) 52. Such networking environments are commonplace in offices, enterprise-wide computer networks, intranets, and the Internet.

When used in a LAN networking environment, the personal computer 20 is connected to the local network 51 through a network interface or adapter 53. When used in a WAN networking environment, the personal computer 20 typically includes a modem 54 or other means for establishing communications over the wide area network 52, such as the Internet. The modem 54, which may be internal or external, is connected to the system bus 23 via the serial port interface 46. In a networked environment, program modules depicted relative to the personal computer 20, or portions thereof, may be stored in the remote memory storage device. It will be appreciated that the network connections shown are exemplary and other means of establishing a communications link between the computers may be used.

Generally, the data processors of computer 20 are programmed by means of instructions stored at different times in the various computer-readable storage media of the computer. Programs and operating systems are typically distributed, for example, on floppy disks or CD-ROMs. From there, they are installed or loaded into the secondary memory of a computer. At execution, they are loaded at least partially into the computer's primary electronic memory. The invention described herein includes these and other various types of computer-readable storage media when such media contain instructions or programs for implementing the steps described below in conjunction with a microprocessor or other data processor. The invention also includes the computer itself when programmed according to the methods and techniques described below. Furthermore, certain sub-components of the computer may be programmed to perform the functions and steps described below. The invention includes such sub-components when they are programmed as described.

For purposes of illustration, programs and other executable program components such as the operating system are illustrated herein as discrete blocks, although it is recognized that such programs and components reside at various times in different storage components of the computer, and are executed by the data processor(s) of the computer.

The illustrated computer uses an operating system such as the "Windows" family of operating systems available from Microsoft Corporation. An operating system of this type can be configured to run on computers having various different hardware configurations, by providing appropriate software drivers for different hardware components. The functionality described below is implemented using standard programming techniques, including the use of OLE (object linking and embedding) and COM (component object interface) interfaces such as described in Rogerson, Dale; *Inside COM*, Microsoft Press, 1997. Familiarity with object-based programming, and with COM objects in particular, is assumed throughout this disclosure.

General Object Architecture

FIG. 2 shows a music generation or playback system 100 in accordance with the invention. In the described embodiment of the invention, various components are implemented as COM objects in system memory 22 of computer 20 (FIG. 1). The COM objects each have one or more interfaces, and each interface has one or more methods. The interfaces and interface methods can be called by application programs and by other objects. The interface methods of the objects are executed by processing unit 21 of computer 20.

Music generation system 100 includes a playback program 101 for playing musical pieces, which are also referred to as performances. The playback program utilizes a performance manager 105 (implemented as a COM object) that controls playback of musical segments. The performance manager is alternatively referred to as a segment manager or a performance object.

A musical segment is a linear interval of music of music that is generated from a combination of musical tracks. In many cases, the music is varied dynamically depending on input parameters and potentially on other factors that the segment tracks are designed to monitor. Generally, a performance comprises a plurality of musical segments, which can be arranged concurrently and/or sequentially within the performance. U.S. Pat. No. 5,753,843, entitled "System and Process for Composing Musical Sections," issued May 19, 1998, describes a system that generates music in this manner. A concurrently-filed U.S. Pat. Application entitled "Track-Based Music Performance Architecture", by inventors Todor C. Fay and Mark T. Burton, describes further features of a system that generates music from segments and tracks.

A segment is represented as a segment object 102. In the described embodiment, a segment object 102 is an instantiation of a COM object class. Each segment object contains references to one or a plurality of track objects 104. The tracks represented by the track objects are played together to render the musical piece represented by the segment object. Conceptually, a segment object is thought of as "containing" its referenced track objects 104. The segment object, which is also referred to as a track manager herein, manages its constituent tracks objects and calls them at appropriate times during a performance.

The track objects are independently executable modules that generate music. Specifically, they generate instructions or commands for music generation components such as computer-integrated MIDI synthesizers, components, and other computer-based music rendering components. For example, a particular track might send MIDI event structures, system exclusive messages, and tempo instructions to a MIDI synthesizer.

There can be many different types of tracks and corresponding track objects, corresponding to different music generation techniques. In many applications, a set of track objects within a segment will cooperate with each other to dynamically generate music in response to options specified by playback program 101 or performance manager 105. In one embodiment, the track objects within a segment object cooperate and communicate with each other through inter-track interfaces to play the music defined by the tracks.

As an example, a segment object might include track objects corresponding to conventional tracks of a MIDI sequence: an event track object, a system exclusive track object, and a tempo map track object. Another segment object might include track objects corresponding to a style-based chord progression music generation technique: a chord progression track object and a style track object or style-based performance track object. In this case, the style track object would play a chord progression defined by the chord progression track.

The segment object of FIG. 2 is an example of a segment having a structure that is conveniently used for representing MIDI files. This segment includes three track objects 104. An event track object 104*a* renders or generates standard MIDI event messages, such as notes, pitch bends, and continuous controllers. A system exclusive track object 104*b* generates MIDI system exclusive messages. A tempo map track object 104*c* generates changes in tempo, packaged as events. When this structure is used in conjunction with MIDI data, each track object includes or receives a corresponding MIDI data stream, parses the data stream, and sends resulting instructions to a MIDI-based rendering component. These particular track objects do not normally participate in shaping the generated music—the music is defined entirely by the original MIDI data stream.

Figure 3:
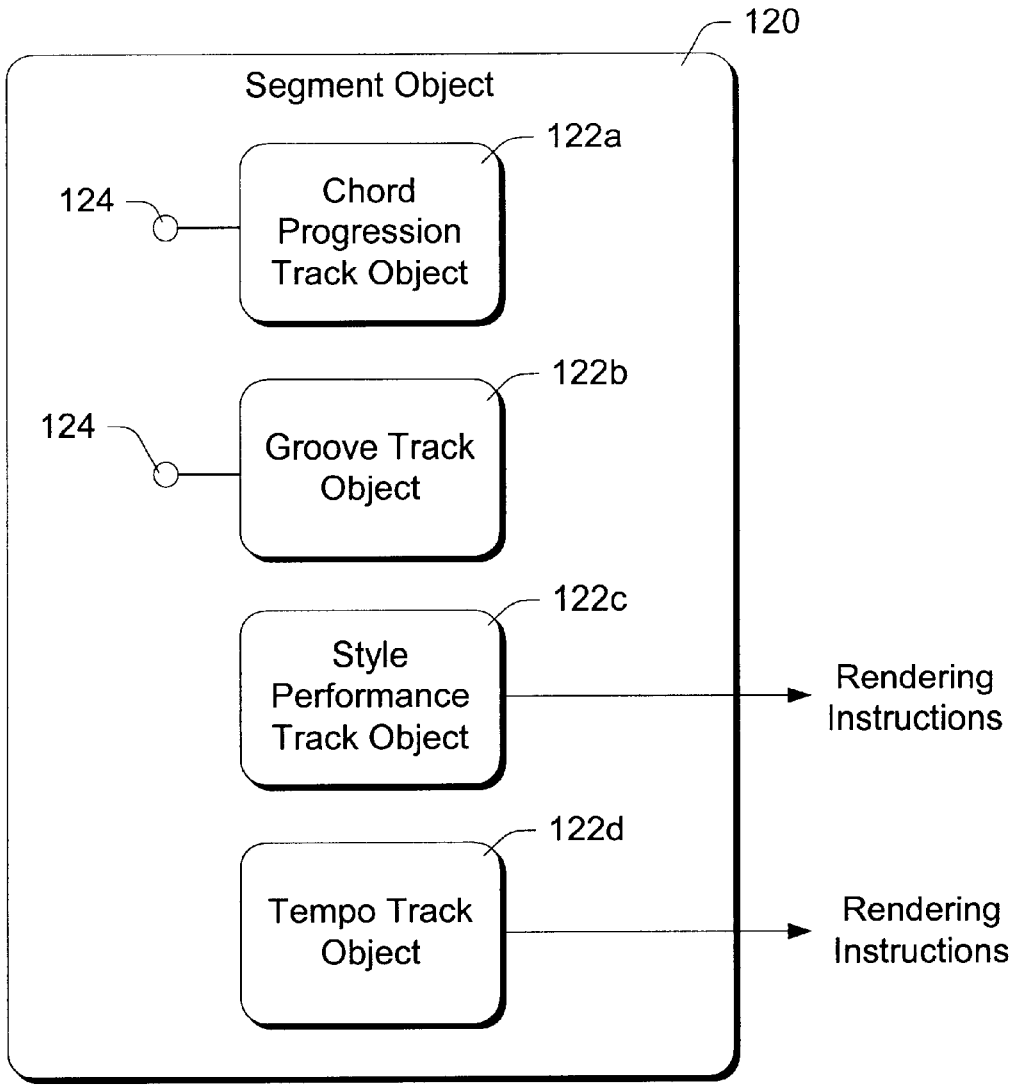
FIG. 3 is a block diagram showing a music segment object and its constituent track objects in accordance with an embodiment of the invention.

FIG. 3 shows a more complex example that allows adaptive creation of music. It includes a segment object 120 and a set of track objects 122 that cooperate to generate style-based and chord-based music. The track objects represent a chord progression track 122*a*, a groove track 122*b*, a style performance track 122*c*, and a tempo map track 122*d*. The chord progression track defines a sequence of chords. The groove track defines an intensity for the segment, which can vary as the segment progresses (as specified by playback program 101 or performance manager 105). The groove track also defines embellishments such as intros, breaks, endings, etc. (which, again, can be specified by playback program 101 or performance manager 105). The style performance track defines a note pattern in terms of the structures defined by the chord progression and groove tracks. The tempo track determines the tempo of the segment, which can vary as the segment progresses.

In the example of FIG. 3, only the style performance track object and the tempo map track object generate actual instructions for downstream music rendering components such as a MIDI-based music generation component. The chord progression track object and the groove track object are "control tracks"—used as sources of data for the style performance track object. In the illustrated embodiment, the track objects have inter-track interfaces 124 that allow data communications between track objects, thereby allowing one track to utilize data from another. Such inter-track communications are described in the previously mentioned US Patent Application filed by Microsoft concurrently herewith, entitled "Track-Based Music Performance Architecture," by inventors Todor C. Fay and Mark T. Burton.

An alternative method of inter-track communications is described in another US Patent Application filed by Microsoft concurrently herewith, entitled "Inter-Track Communication of Musical Performance Data," by inventors Todor C. Fay and Mark T. Burton.

In addition to inter-track interfaces, track objects can have interfaces that accept commands from other program components during playback, thereby allowing an application program to vary a performance as it is in progress.

Various types of track objects are possible, utilizing widely varying forms of music generation. For example, track objects might utilize synchronized streaming audio wave files or combinations of pre-recorded audio files. Other track objects might render music with synchronized textual lyrics (such as in a karaoke device). Track objects might also use algorithmic techniques to generate music. The object-oriented architecture of the system allows such different techniques to be implemented entirely within the tracks-neither the segment object nor the performance manager need to have any knowledge of the inner workings of the track objects.

Because the described embodiment of the invention is implemented with COM technology, each type of track corresponds to an object class and has a Corresponding object type identifier or CLSID (class identifier). A track object as shown in FIG. 2 or FIG. 3 is actually an instance of a class. The instance is created from a CLSID using a COM function called CoCreateInstance.

A particular track object class is designed to support a specific type of music generation technology, which generally corresponds to a particular type of music-related data. For example, MIDI object classes are designed to support MIDI-formatted data, and define functions for rendering music from such data. The rendering functions of different classes differ depending on the type of music performance data that is accepted and interpreted. When first instantiated, the track object does not contain actual music performance data (such as a MIDI sequence or chord progression). However, each track exposes a stream I/O interface method through which music performance data is specified. FIGS. 2 and assume that each track object has already been initialized with its music performance data.

All of the track objects, regardless of the track object classes from which they were instantiated, support an identical object interface referred to as a track interface 110. Track interface 110 includes a track play method that is callable to play a time-delineated portion of a track.

Although track objects are instantiated from different object classes, all segment objects are instantiated from the same object class. The segment object class is defined to expose a segment interface 112. Segment interface 112 includes a number of methods, including a segment play method that is callable to play a time-delineated portion of the musical segment represented by the segment object.

To play a particular musical piece, performance manager 105 calls segment object 102 and specifies a time interval or duration within the musical segment. The segment object in turn calls the track play methods of each of its track objects, specifying the same time interval. The track objects respond by independently rendering their music at during the specified interval. This is repeated, designating subsequent intervals, until the segment has finished its playback.

This architecture provides a great degree of flexibility. A particular performance is implemented as a segment object and a plurality of associated track objects. Playback program 101 and its performance manager 105 play the musical piece by making repeated calls to segment interface 112 to play sequential portions of the musical piece. The segment object, in turn, makes corresponding calls to the individual track interfaces 110. The track objects perform the actual music generation, independently of the playback program, of the performance object, and of the segment object.

Because of this architecture, the independence of the track objects, and the support for identical predefined track interfaces, the playback program itself is not involved in the details of music generation. Thus, a single playback program can support numerous playback technologies, including technologies that are conceived and implemented after completion of the playback program.

Multiple Segment Instances

The architecture described above allows multiple segment objects and sets of track objects to be active at the same time. Different segments can overlap in time or can be played sequentially.

For a variety of reasons, it may be desirable to play multiple instances of a given segment concurrently. That is, a single segment might be initiated at several different times during a performance, resulting in different instances of the segment that overlap each other in time. Because a segment is implemented as a set of tracks, each segment instance corresponds to a set of track instances. Thus, playing multiple concurrent segment instances involves playing multiple concurrent instances of one or more tracks.

In accordance with the invention, the segment object acts as a track manager to maintain or otherwise keep track of state information for each instance of its constituent track objects, thus eliminating the need to create duplicate track objects for multiple track instances.

Figure 4:
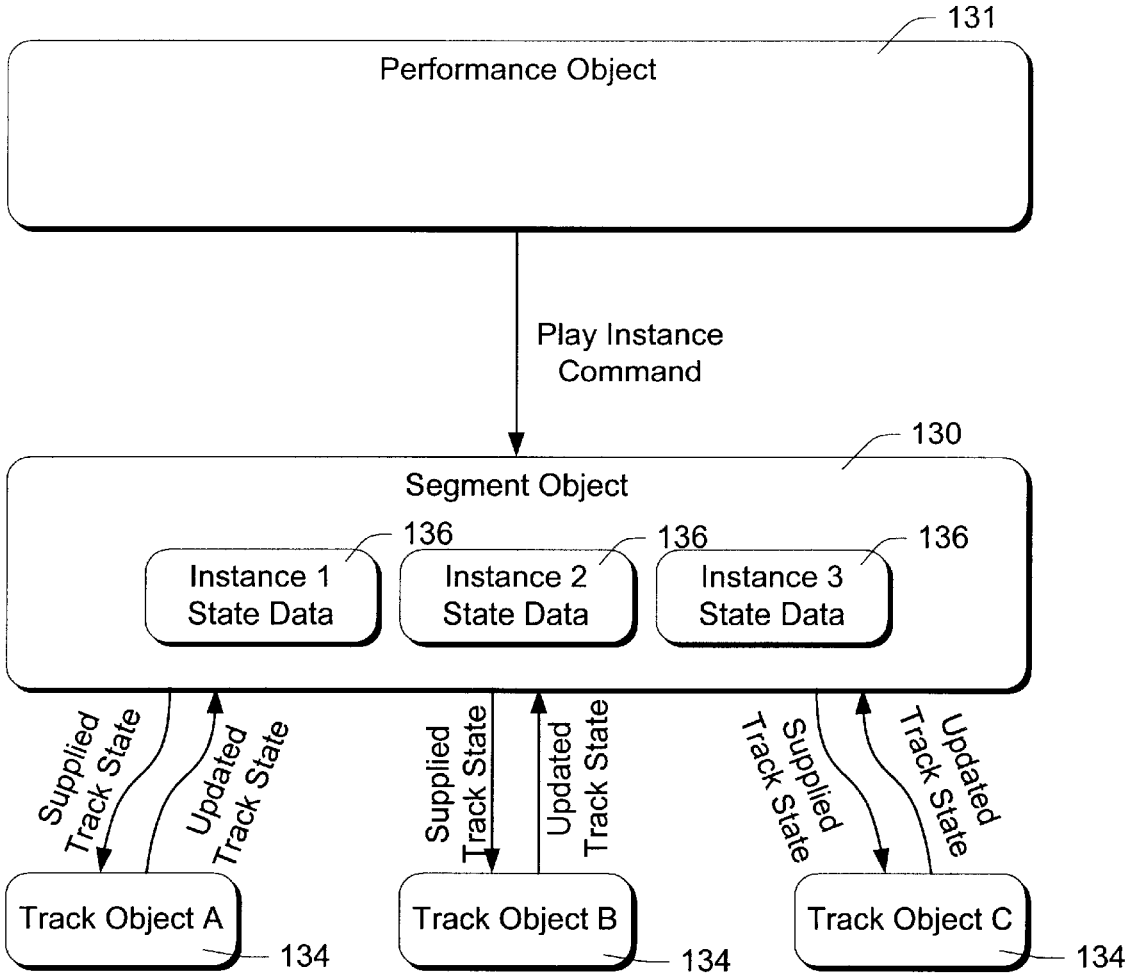
FIG. 4 is a block diagram showing software components for playing segment-based music in accordance with another embodiment of the invention.

FIG. 4 shows one embodiment of the invention in which a segment object 130 maintains state information for its constituent track objects. In this embodiment, a performance manager 131 performs generally the same functions as those performed by performance manager 105 of FIG. 2. The performance manager in this case is implemented as a COM object, with a performance interface (not shown) that is called by an application program to play specified segment objects and instances of segment objects.

Segment object 130 references a plurality of track objects 134 as described above. The track objects are COM objects having interfaces that are callable to play portions of the tracks, as generally described above. In this embodiment, however, the track play method of each track object accepts an argument comprising a pointer to track state information.

Segment object 130 stores state information for its track objects. The state information for any given track object is stored in a memory format particular to that track object, which has no meaning to the segment object.

Each track object has an instance initialization method that segment object 130 calls to create a new instance of the track. In response to invocation of the instance initialization method, the track formats whatever state information it requires, and returns the state information to the segment object. In practice, the state information is returned as a pointer to a block of memory containing the state information. The segment object maintains such state information (in the form of memory pointers) for the various track objects, and provides it to the track objects when calling the track play methods of the track objects.

In FIG. 4, it is assumed that the performance object 132 has initialized three instances of the segment represented by segment object 130: Instance 1, Instance 2, and Instance 3. As shown, the segment object maintains state information 136 for each of these segment instances. For each segment instance, the corresponding state information 136 contains a pointer corresponding to the state information of each of track objects 134.

To play a particular segment, performance object 131 calls segment object 130 and specifies both the desired instance of the segment and a time interval or duration within the instance. The segment object in turn calls the track play methods of each of its track objects, specifying same time interval. In addition, the segment object specifies state information (in the form of a memory pointer) that corresponds to the requested segment instance and to the particular track object being called. The track objects respond by independently rendering their music at the specified times, in accordance with the specified state information. In addition, each track object updates the provided state information to define a new track state of the track instance, and returns the updated state information (or the pointer that references such state information) to the calling segment object.

Figure 5:
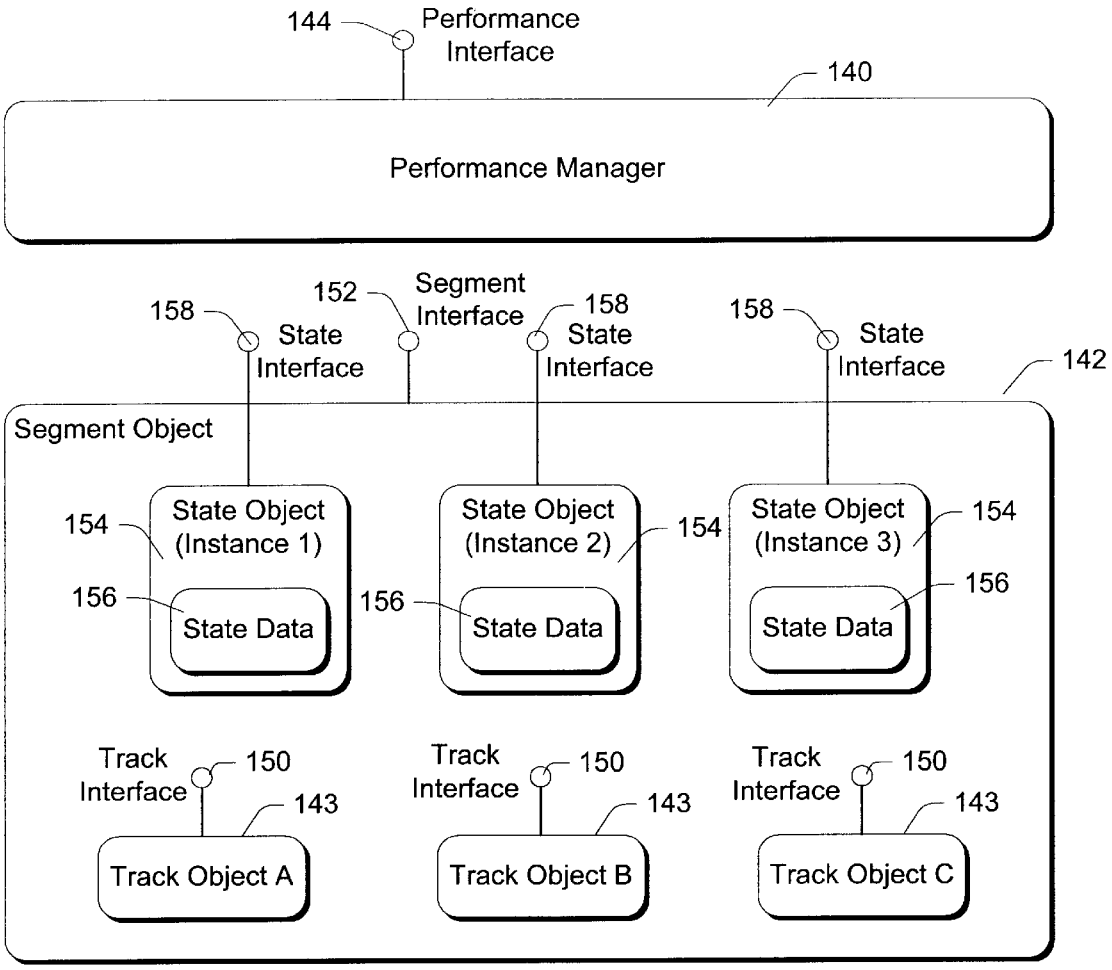
FIG. 5 is a block diagram showing software components for playing segment-based music in accordance with yet another embodiment of the invention.

FIG. 5 shows another embodiment of the invention in which state information is maintained for different segment and track instances. This embodiment includes a performance manager 140 and a plurality of segment objects 142 (only one of which is shown for purpose of illustration). Each segment object 142 comprises a plurality of track objects 143 representing different musical tracks. As described above, the tracks when played together form a musical segment that is in turn part of a larger overall performance. The single segment object shown has three track objects A, B, and C, which are played in conjunction with each other to form the segment represented by segment object 142.

The performance object has a performance interface 144 having methods that are callable by an application program to manage and playback segments within a performance. One of the methods is a PlaySegment method that can be called to initialize an instance of a segment. This method will be described in more detail below.

Each track object 143 has a track interface 150 that supports a play method that is callable to play a time-delineated portion of its musical track. The track play method accepts a time duration parameter that indicates the duration to be played of the track. In addition, the track play method accepts a pointer to state information that defines a current track state of a track object's musical track. The track play method begins playback of its track at the temporal point in the track following the portion of the track played during the most recent call to the track play method that specified the same state information. This, along with other information regarding track playback, is determined by the state information provided during the call to the track object. The length of the portion of the track played by the track play method is determined by the time parameter supplied as an argument to the track play method.

Segment object 142 has a segment interface 152 that includes an instance initialization method. The instance initialization method is callable to instantiate multiple state objects 154 representing different segment instances of the segment represented by segment object 142. Each state object 154 keeps track of state information 156 for different track instances corresponding to the segment instance represented by the state object. For example, the state object for segment instance 1 maintains a list of pointers that reference state information for a first instance of each of tracks 143-corresponding to a first instance of the segment represented by segment object 142. Similarly, the state object for segment instance 2 maintains a list of pointers that reference state information for a second instance of each of tracks 143—corresponding to a second instance of the segment represented by segment object 142.

Each of the state objects has a state object interface 158 that includes a segment play method. The segment play method of a particular state object is iteratively callable to play the state object's segment instance. The state object responds to its segment play method by calling the track play methods of track objects 143 with the state information pointers maintained by the state object for the different track objects. The track play method of a particular track object responds, in turn, by playing a portion of the track object's musical track in accordance with a current track state defined by the state information. During playback, the track object updates its state information as necessary.

Figure 6:
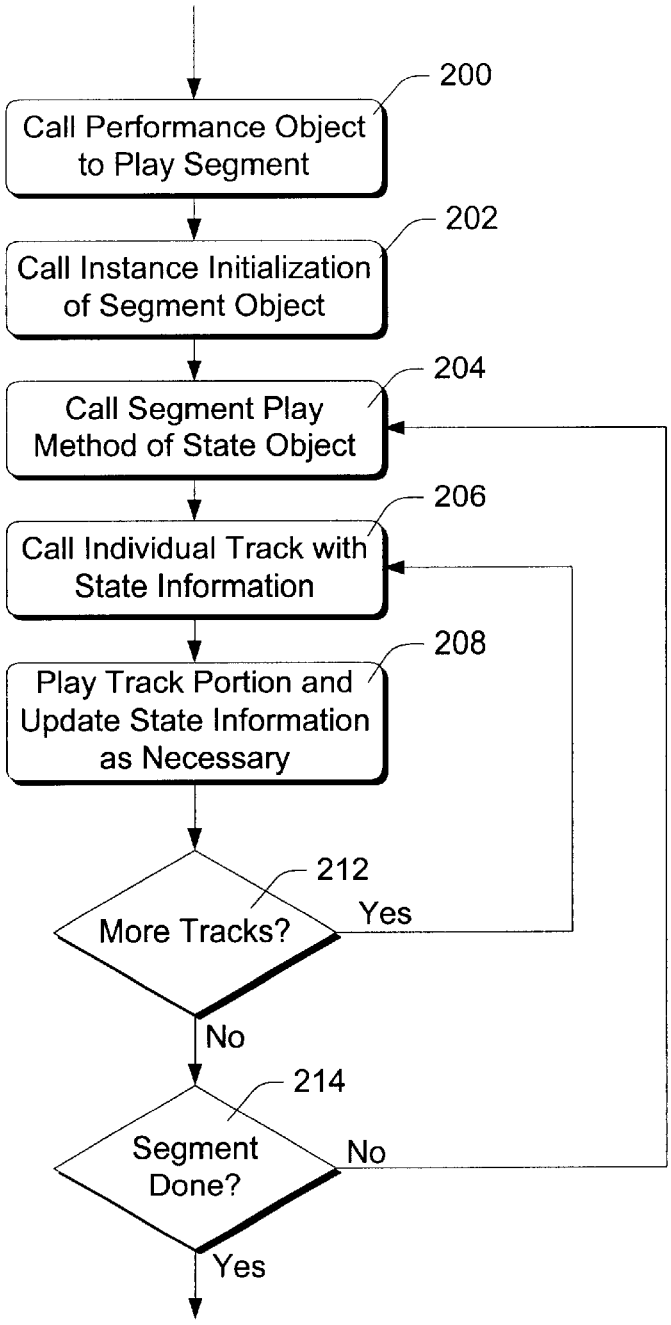
FIG. 6 is a block diagram showing steps performed in accordance with the invention.

FIG. 6 illustrates steps that are performed by the various components to instantiate and play an instance of a segment. A step 200 comprises calling the segment play method of a performance object to play a specified segment object. The performance object responds by performing a step 202 of calling the instance initialization method of the specified segment object to instantiate a new state object representing a new instance of the segment represented by the segment object. The instance initialization method returns a reference to an interface that exposes the segment play method of the newly-instantiated state object.

Step 204 comprises repeatedly calling the segment play method of the instantiated state object to play the new segment instance. Step 206, performed by the state object in response to its segment play method, comprises calling a constituent track of the segment object which instantiated the state object, specifying state information corresponding to both the track and the segment instance and a duration for which the track object is to play. As discussed above, the state information is passed by reference, as a memory pointer.

The track object, in step 208, plays its track for the specified duration and updates the state information as necessary.

Decision block 212 indicates that steps 206, and 208 are reiterated for each track object of the segment object. Decision block 214 indicates that steps 204, 206, and 208 are reiterated until playback of the segment has completed.

In practice, the steps shown in FIG. 6 are initiated and performed numerous different times to instantiate multiple state objects representing different instances of a musical segment and to play the instances during concurrent or overlapping times. Note that segment instances can be initiated multiple times from a single performance, and also can be initiated from multiple different performances.

Interface Method Details

Embodiments of the invention have been described above with particular emphasis on the functionality and interaction of the various components and objects. The following sections describe specific interface methods that are supported by the various objects.

Performance Interface Methods

A performance object in accordance with the described embodiments of the invention supports the following pertinent interface methods:

PlaySegment. The PlaySegment method is called by an application program to play an instance of a segment. As arguments, the PlaySegment method accepts a memory reference to a segment object, various flags, and an indication of when the segment instance should start playing. The flags indicate details about how the segment should relate to other segments and whether the segment should start immediately after the specified time or only on a specified type of time boundary (such as a measure, beat, or sub-beat). PlaySegment returns a memory pointer to the state object that is eventually instantiated as a result of calling PlaySegment.

StopSegment. This method is called by an application program to stop a specified instance of a segment. Arguments include a memory pointer to the state object that represents the segment instance to be stopped and a memory pointer to the segment object that was previously called to instantiate the state object. In addition, StopSegment accepts arguments specifying when the segment should be stopped, including the flags discussed above regarding whether the segment should be stopped on a specified type of time boundary.

Segment Interface Methods

The segment object methods include methods for setting playback parameters of a segment, methods for access and managing tracks of a segment, and the following method for initializing a segment instance and instantiating a corresponding state object:

InstanceInitialize. This method is called by the PlaySegment method of the performance object to create a state object corresponding to a new instance of the segment represented by the segment object. Arguments include a pointer to the performance object that is responsible for calling InstanceInitialize and flags indicating whether the instance should start on specified boundaries. InstanceInitialize creates a state object and initializes it with references to the track objects of the segment object. It returns a memory pointer to the newly created state object, so that the performance object can later call the state object directly.

State Object Interface Methods

An instantiated state object supports the following pertinent methods:

SetOffset. This method is used to specify a start time for the segment instance represented by the state object.

Play. The Play method accepts an argument indicating the length of time over which the segment instance should be played. It returns the length of time actually played. This method calls the track objects with state information maintained for a particular segment instance to play the tracks over the specified length of time.

Track Interface Methods

Each track object supports the following pertinent methods:

InitPlay. The InitPlay method is called prior to beginning the playback of a track, by a state object at the time the state object is instantiated. Calling InitPlay allows the track object to create an initial set of state information that will be used during playback of a track instance. Arguments to this method include a pointer to the calling state object and a pointer to the performance object that is ultimately responsible for playback of the track. In addition, flags are provided indicating whether the track is to start on a specific type of music boundary. InitPlay returns a pointer to the created state information for retention by the calling state object.

Play. This method is called by a state object to play a specified portion of a music track. Play accepts arguments corresponding to a start time, an end time and an offset within the track performance data. In addition, the calling state object provides a pointer to state data that is used by the track object to maintain consistency of different instances of the track represented by the track object. When this method is called, the track object renders the music defined by the start and end times, in accordance with the state data provided by the calling state object. The track object also updates the state data appropriately. The offset indicates the position in the overall performance relative to which the start and end times are to be interpreted.

EndPlay. This method is called by the segment state object upon finishing or ending the playback of a track.

This allows the track object to free its state memory. A single argument is provided to EndPlay, comprising a pointer to the state information relevant to the subject instance of the track represented by the track object.

Conclusion

The system described above allows numerous instances of segments and their tracks to be played concurrently without requiring duplication of the objects representing the segments and tracks. This is a significant advantage, and greatly reduces the amount of memory that would otherwise by consumed.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. One or more computer-readable media containing a computer program comprising:

a plurality of track objects representing different musical tracks;

a track manager that calls the track objects iteratively to play multiple track instances of at least a particular one of the musical tracks;

wherein the track manager indicates state information when calling the particular track object representing said particular musical track, the state information defining a current track state of a particular one of the multiple track instances of said particular musical track;

wherein said particular track object responds to the supplied state information by playing a portion of said particular musical track in accordance with the current track state defined by the indicated state information;

wherein the track manager keeps track of state information corresponding to said multiple track instances of said particular musical track.

2. A computer-readable media as recited in claim 1, wherein the portion of said particular musical track that the track object plays begins at a time in the particular musical track that is determined by the indicated state information.

3. A computer-readable media as recited in claim 1, wherein the portion of said particular musical track that the track object plays is determined by the indicated state information and by a time duration that is supplied by the track manager to the track object.

4. A computer-readable media as recited in claim 1, wherein track manager and the track object are COM objects.

5. A computer comprising the computer-readable media recited in claim 1.

6. One or more computer-readable media containing a computer program comprising:

a plurality of track objects representing different musical tracks that form a segment of music when played together;

a segment object representing the segment of music;

the segment object being callable to instantiate multiple state objects representing different segment instances of the segment of music;

each of the state objects being callable to play a corresponding one of the different segment instances;

wherein each state object iteratively calls the track objects to play the different segment instances;

wherein each state object indicates state information when calling the track objects, the state information defining current track states of track instances corresponding to the different segment instances;

wherein a particular track object responds to the supplied state information by playing a portion of said track object's musical track in accordance with a current track state defined by the indicated state information;

wherein each state object keeps track of state information for each of the musical tracks between iterative calls to the track objects.

7. A computer-readable media as recited in claim 6, the computer program further comprising a performance manager that calls the segment object to instantiate a state object representing a new segment instance of the segment of music, and wherein the performance manager repeatedly calls the instantiated state object to play the new segment instance.

8. A computer-readable media as recited in claim 6, wherein the portion of said track object's musical track that the track object plays begins at a time that is determined by the indicated state information.

9. A computer-readable media as recited in claim 6, wherein the portion of said track object's musical track that the track object plays is determined by the indicated state information and by a time duration that is supplied as an argument by the state object to said particular track object.

10. A computer-readable media as recited in claim 6, wherein the recited objects are COM objects.

11. A computer-readable media as recited in claim 6, further comprising a plurality of segment objects representing different segments of music and referencing different sets of track objects.

12. A computer comprising the computer-readable media recited in claim 6.

13. One or more computer-readable media containing a computer program comprising:

a plurality of track objects representing different musical tracks that form a segment of music when played together;

each track object having a play method that is callable to play a time-delineated portion of its musical track, wherein the play method accepts an indication of state information that defines a current track state of a particular instance of the track object's musical track;

a segment object representing the segment of music, wherein the segment object has references to the plurality of track objects;

wherein the segment object has an instance initialization method that is callable to instantiate multiple state objects representing different segment instances of the segment of music;

wherein each state object keeps track of state information for different track instances corresponding to the segment instance represented by the state object;

wherein each of the state objects has a segment play method that is iteratively callable to play a portion of a corresponding one of the different segment instances;

wherein each state object responds to its segment play method by calling the track play methods of the track objects with an indication of the state information kept track of by the state object;

wherein the track play method of a particular track object responds to a call by a particular state object with the indication of state object's state information by playing a portion of said track object's musical track in accordance with a current track state defined by the state information.

14. A computer-readable media as recited in claim 13, the computer program further comprising a performance object having a segment play method that is callable to play the segment of music that is represented by an identified segment object, wherein upon being called to play the segment of music the segment play method performs steps comprising:

calling the instance initialization method of the identified segment object to instantiate a state object representing a new segment instance of the segment of music;

repeatedly calling the segment play method of the instantiated state object to play the new segment instance.

15. A computer-readable media as recited in claim 13, wherein the portion of the track object's musical track that is played by the track play method begins at a time in the musical track that is determined by the supplied state information.

16. A computer-readable media as recited in claim 13, wherein the portion of the track object's musical track that is played by the track play method is determined by the indicated state information and by a time duration that is supplied as an argument to the track play method.

17. A computer-readable media as recited in claim 13, wherein the recited objects are COM objects.

18. A computer-readable media as recited in claim 13, wherein the recited methods are COM object methods.

19. A computer-readable media as recited in claim 13, further comprising a plurality of segment objects representing different segments of music and referencing different sets of track objects.

20. A computer comprising the computer-readable media recited in claim 13.

21. A method of playing a music performance, comprising:

identifying a segment object that represents the segment of music, wherein the segment object references a plurality of track objects, the referenced track objects representing different musical tracks that form the segment of music when played together;

calling the segment object to instantiate multiple state objects representing different segment instances of the segment of music;

calling the state objects to play corresponding ones of the different segment instances;

iteratively calling the track objects from the state objects to play the different segment instances;

indicating state information when calling the track objects from the state objects, the state information defining current track states of track instances corresponding to the different segment instances;

in response to indicated state information, a particular track object playing a portion of said track object's musical track in accordance with a current track state defined by the supplied state information;

each state object keeping track of state information for each of the musical tracks that form the segment of music.

22. A method as recited in claim 21, wherein the portion of said track is object's musical track that the track object plays begins at a time that is determined by the indicated state information.

23. A method as recited in claim 21, wherein the portion of said track object's musical track that the track object plays is determined by the indicated state information and by a time duration that is supplied as an argument by the state object to said particular track object.

24. A method as recited in claim 21, wherein the recited objects are COM objects.

25. A method as recited in claim 21, further comprising identifying a plurality of segment objects representing different segments of music and referencing different sets of track objects.

26. A computer programmed to perform steps comprising the steps recited in claim 21.

27. A computer programmed to perform steps comprising:

identifying a plurality of track objects representing different musical tracks that form a segment of music when played together;

instantiating multiple state objects representing different segment instances of the segment of music;

calling the state objects to play corresponding ones of the different segment instances;

iteratively calling the track objects from the state objects to play the different segment instances;

indicating state information when calling the track objects from the state objects, the state information defining current track states of track instances corresponding to the different segment instances;

in response to indicated state information, a particular track object playing a portion of said track object's musical track in accordance with a current track state defined by the supplied state information;

each state object keeping track of state information for each of the musical tracks that form the segment of music.

28. A method as recited in claim 27, wherein the portion of said track object's musical track that the track object plays begins at a time that is determined by the indicated state information.

29. A method as recited in claim 27, wherein the portion of said track object's musical track that the track object plays is determined by the indicated state information and by a time duration that is supplied as an argument by the state object to said particular track object.

30. A method as recited in claim 27, wherein the recited objects are COM objects.

* * * * *

UNITED STATES PATENT AND TRADEMARK OFFICE

CERTIFICATE OF CORRECTION

PATENT NO. : 6,433,266 B1
DATED : August 13, 2002
INVENTOR(S) : Fay

It is certified that error appears in the above-identified patent and that said Letters Patent is hereby corrected as shown below:

Column 8,
Line 17, replace “Corresponding” with -- corresponding --.
Line 34, insert -- 3 -- between “and” and “assume”.

Column 16,
Line 7, delete “is” after “track”.

Signed and Sealed this

Fourteenth Day of January, 2003

JAMES E. ROGAN
*Director of the United States Patent and Trademark Office*